US012320537B2

(12) United States Patent
Daryani et al.

(10) Patent No.: US 12,320,537 B2
(45) **Date of Patent: *Jun. 3, 2025**

(54) METHOD FOR EFFICIENT DEPLOYMENT OF A CLUSTER OF AIR PURIFICATION DEVICES IN LARGE INDOOR AND OUTDOOR SPACES

(71) Applicant: Praan Inc., San Francisco, CA (US)

(72) Inventors: Angad Daryani, Mumbai (IN); FNU Sanat Kumar, Sunnyvale, CA (US); Pranjal LNU, Gurugram (IN); Prajwal Bhagat, Mumbai (IN)

(73) Assignee: PRAAN INC., San Francisco, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/518,561

(22) Filed: Nov. 23, 2023

(65) Prior Publication Data

US 2024/0353139 A1 Oct. 24, 2024

Related U.S. Application Data

(63) Continuation of application No. 18/304,707, filed on Apr. 21, 2023, now Pat. No. 11,867,422.

(51) Int. Cl.
*F24F 11/74* (2018.01)
*F24F 110/65* (2018.01)

(52) U.S. Cl.
CPC ..... *F24F 11/74* (2018.01); *F24F 2110/65* (2018.01)

(58) Field of Classification Search
CPC ..... F24F 2110/65; F24F 11/74
See application file for complete search history.

(56) References Cited

U.S. PATENT DOCUMENTS

| | | | | |
|---|---|---|---|---|
| 11,867,422 | B1 * | 1/2024 | Daryani | F24F 11/63 |
| 2006/0234621 | A1 * | 10/2006 | Desrochers | F24F 3/044 702/50 |
| 2019/0369628 | A1 * | 12/2019 | Kim | G05D 1/0221 |
| 2021/0133561 | A1 * | 5/2021 | Yoon | G06N 5/02 |
| 2021/0164682 | A1 * | 6/2021 | Mujumdar | F24F 8/175 |
| 2021/0356158 | A1 * | 11/2021 | Kwon | F24F 11/0001 |
| 2022/0042694 | A1 * | 2/2022 | He | F24F 11/30 |
| 2022/0304529 | A1 * | 9/2022 | Jones | A47L 9/28 |

* cited by examiner

*Primary Examiner* — Mohammad Ali
*Assistant Examiner* — Vincent W Chang
(74) *Attorney, Agent, or Firm* — Climate Patent Collective LLC

(57) ABSTRACT

A method for distributing a set of air purification devices in a target space comprising: accessing a void volume representing the target space; accessing a set of observed parameter data streams recorded by a set of air sensors with the target space during an observation period, the set of observed parameter data streams comprising a set of pollutant concentration data streams of a pollutant, a set of air speed data streams, and a set of air direction data streams; simulating a distribution of the pollutant in the void volume reproducing the set of observed parameter data streams based on the set of observed parameter data streams; accessing a set of device characteristics for a set of air purification devices to be deployed within the target space; and calculating a set of device positions in the void volume based on the distribution of the pollutant and the set of device characteristics.

16 Claims, 13 Drawing Sheets

METHOD FOR EFFICIENT DEPLOYMENT OF A CLUSTER OF AIR PURIFICATION DEVICES IN LARGE INDOOR AND OUTDOOR SPACES

CROSS-REFERENCE TO RELATED APPLICATIONS

This application is a continuation application of U.S. patent application Ser. No. 18/304,707, filed on 21 Apr. 2023, which is incorporated in its entirety by this reference.

TECHNICAL FIELD

This invention relates generally to the field of large indoor and outdoor air purification and, more specifically, to a new and useful method for air purification devices in the field of large indoor and outdoor air purification.

DESCRIPTION OF THE EMBODIMENTS

The following description of embodiments of the invention is not intended to limit the invention to these embodiments but rather to enable a person skilled in the art to make and use this invention. Variations, configurations, implementations, example implementations, and examples described herein are optional and are not exclusive to the variations, configurations, implementations, example implementations, and examples they describe. The invention described herein can include any and all permutations of these variations, configurations, implementations, example implementations, and examples.

1. Method

Figure 1A:
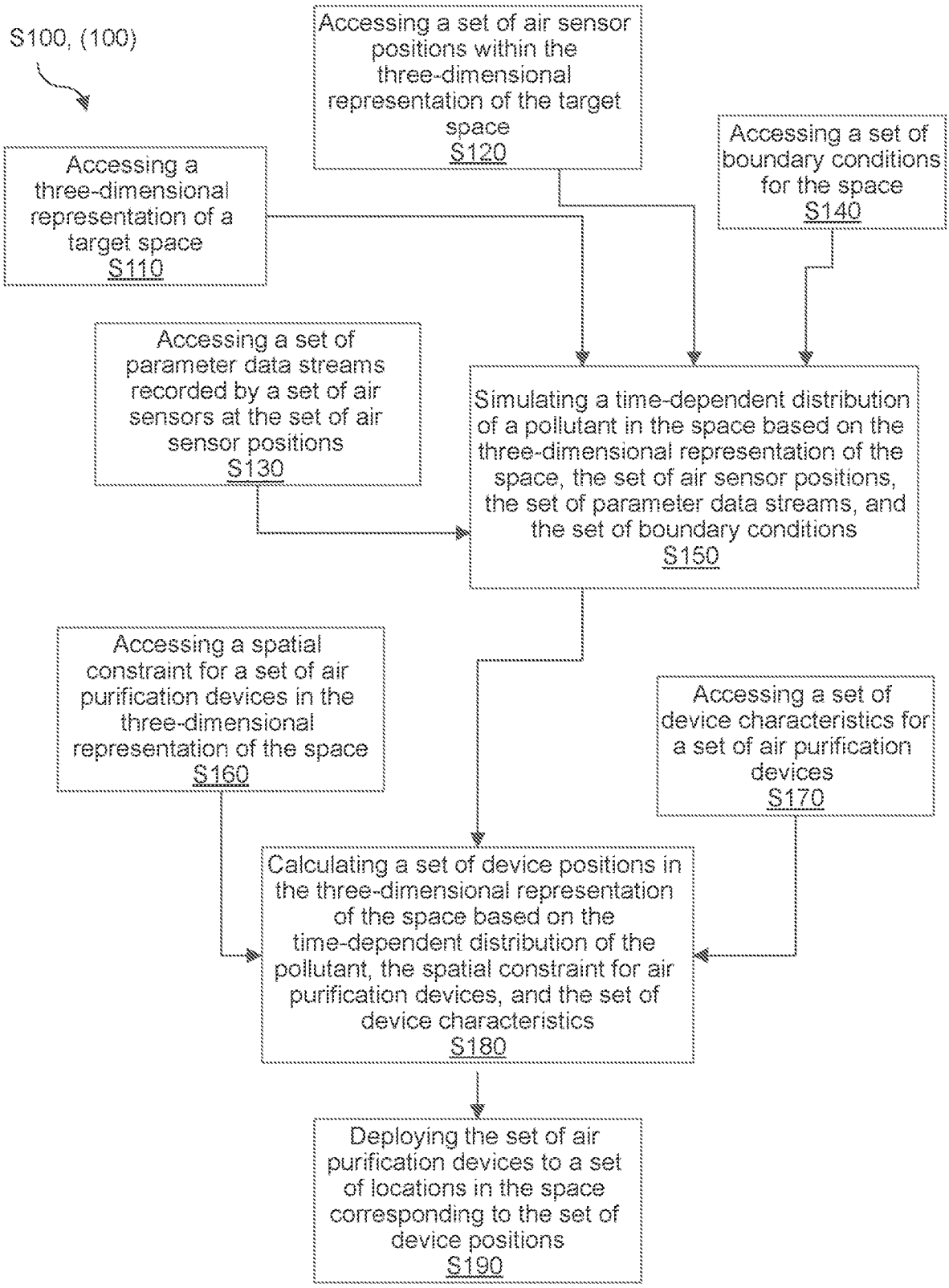
FIG. 1A is a flowchart representation of a method.

As shown in FIG. 1A, a method S100 for deploying a set of air purification devices in a target space includes: accessing a three-dimensional representation of the target space in Step S110; accessing a set of air sensor positions within the three-dimensional representation of the target space corresponding to a set of air sensors positioned within the target space in Step S120; accessing a set of parameter data streams recorded by the set of air sensors during an observation period, the set of parameter data streams including: a set of pollutant concentration data streams, a set of air speed data streams, and a set of air direction data streams, each parameter data stream in the set of parameter data streams corresponding to an air sensor position in the set of air sensor positions in Step S130; accessing a set of boundary conditions for the three-dimensional representation of the target space in Step S140; simulating a time-dependent distribution of a pollutant in the three-dimensional representation of the target space reproducing the set of parameter data streams based on the set of air sensor positions, the set of parameter data streams, and the set of boundary conditions in Step S150; accessing a spatial constraint for air purification devices in the three-dimensional representation of the target space in Step S160; accessing a set of device characteristics for a set of air purification devices to be deployed within the target space in Step S170; calculating a set of device positions in the three-dimensional representation of the target space based on the time-dependent distribution of the pollutant, the spatial constraint for air purification devices, and the set of device characteristics in Step S180; and deploying the set of air purification devices to a set of locations in the target space corresponding to the set of device positions in Step S190.

Figure 1B:
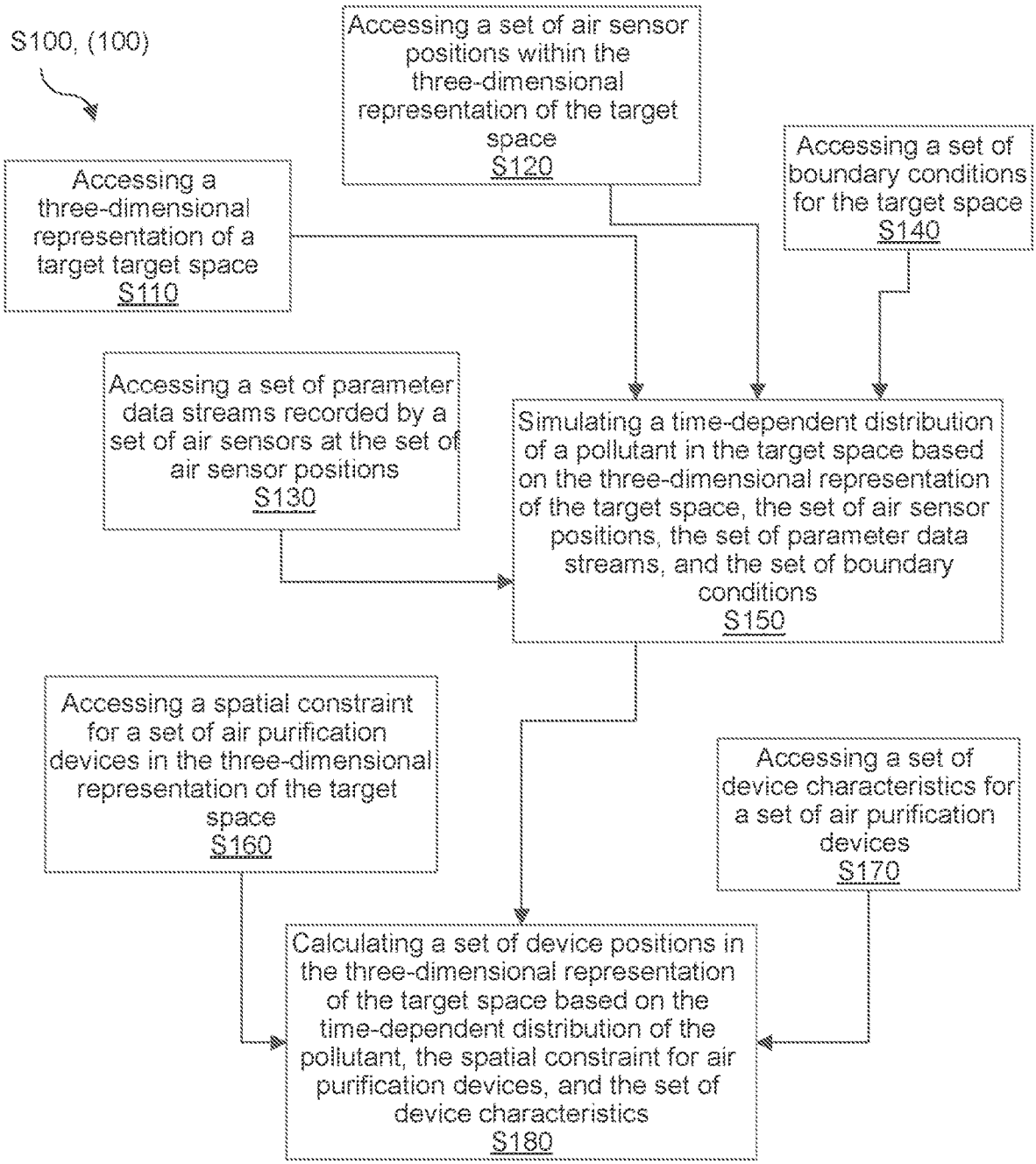
FIG. 1B is a flowchart representation of one variation of the method.

As shown in FIG. 1B, one variation of the method S100 includes: accessing a representation of the target space in Step S110; accessing a set of air sensor positions within the representation of the target space corresponding to a set of air sensors positioned within the target space in Step S120; accessing a set of observed parameter data streams recorded by the set of air sensors during an observation period, the set of observed parameter data streams comprising a set of pollutant concentration data streams of a pollutant, a set of air speed data streams, and a set of air direction data streams, each parameter data stream in the set of observed parameter data streams corresponding to an air sensor position in the set of air sensor positions in Step S130; accessing a set of boundary conditions for the representation of the target space in Step S140; simulating a distribution of the pollutant in the representation of the target space reproducing the set of observed parameter data streams based on the set of air sensor positions, the set of observed parameter data streams, and the set of boundary conditions in Step S150; accessing a spatial constraint for air purification devices in the representation of the target space in Step S160; accessing a set of device characteristics for a set of air purification devices to be deployed within the target space in Step S170; and calculating a set of device positions in the representation of the target space based on the distribution of the pollutant, the spatial constraint for air purification devices, and the set of device characteristics in Step S180.

Figure 1C:
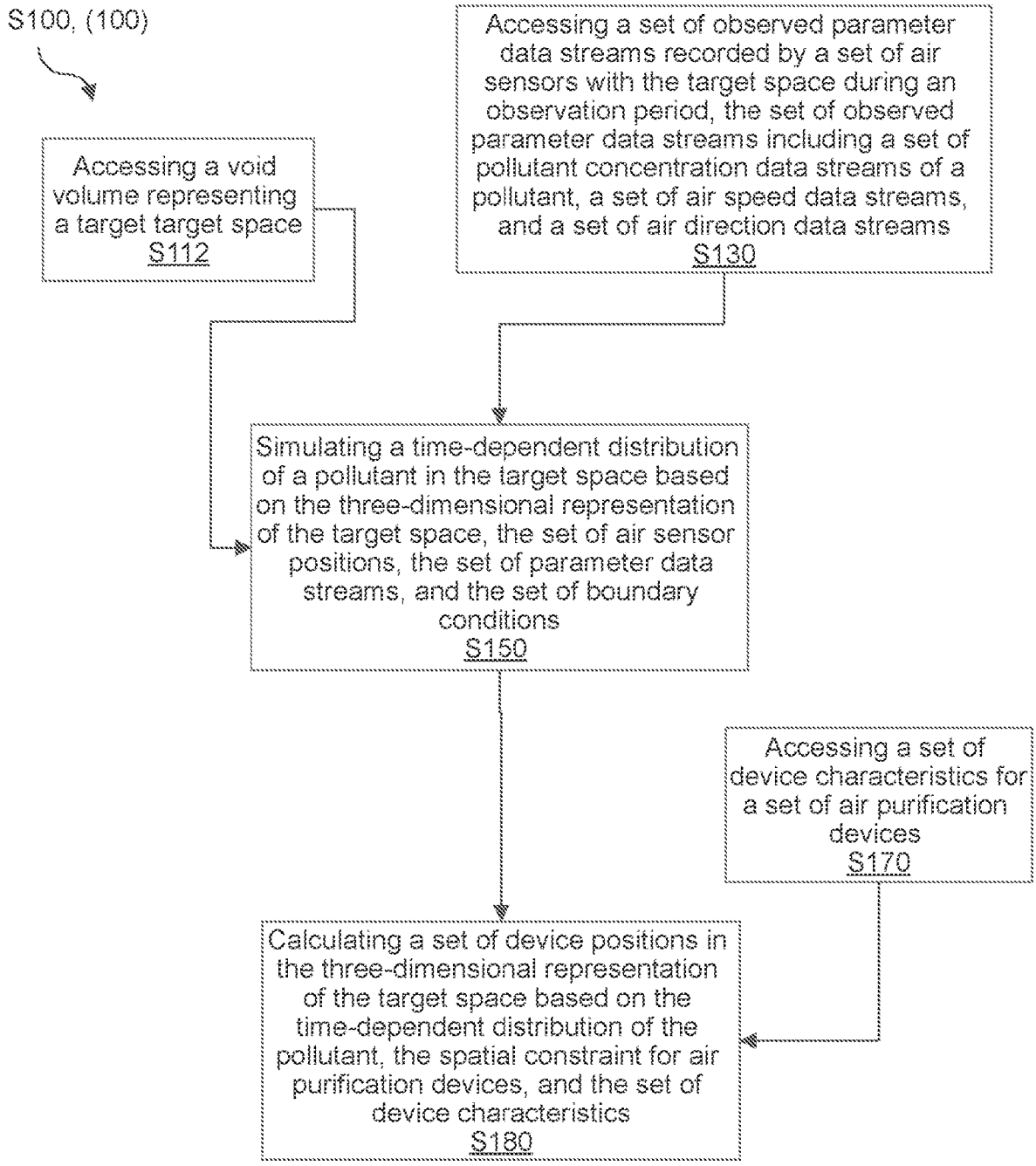
FIG. 1C is a flowchart representation of one variation of the method.

As shown in FIG. 1C, one variation of the method S100 includes: accessing a void volume representing the target space in Step S112; accessing a set of observed parameter data streams recorded by a set of air sensors with the target space during an observation period, the set of observed parameter data streams including a set of pollutant concentration data streams of a pollutant, a set of air speed data streams, and a set of air direction data streams in Step S130; simulating a distribution of the pollutant in the void volume resulting in a minimal error relative to the set of observed parameter data streams based on the set of observed parameter data streams in Step S150; accessing a set of device characteristics for a set of air purification devices to be deployed within the target space in Step S170; and calculating a set of device positions in the void volume based on the distribution of the pollutant and the set of device characteristics in Step S180.

2. Applications

Generally, the method S100 is executed by a computer system 100 (hereinafter, "system 100") that receives a set of parameter data streams, including pollutant concentrations (e.g., particulate matter, VOCs, $CO_2$), air speed, and air direction from a set of air sensors positioned throughout an indoor or outdoor target space (e.g., a factory, warehouse, city block, park, or tunnel). The system simulates a distribution of the pollutant based on a three-dimensional representation of the target space (e.g., obtained via floorplan analysis, LIDAR, computer vision, or a combination thereof) and the parameter data streams via computational fluid dynamics to accurately estimate the spatial distribution of the pollutant in the target space. The system can then leverage the time-dependent distribution of the pollutant to calculate a set of positions for a set of air purification devices that improves the impact of the set of air purification devices on the air quality of the target space. Thus, the system enables the efficient deployment of a large number of air purification devices to large indoor and outdoor target spaces, thereby minimizing the size of investment required to purify air on a large scale, such as across an entire city.

Due to the nature of large, polluted target spaces, the system receives as input a set of spatial constraints on the positions of the air purification devices that enables the system to generate realistic positions for the deployment of the air purification devices. For example, the system can receive as input spatial constraints identifying working or occupied regions of a factory floor, regions without electrical power supplies sufficient to power an air purification device, or regions of the target space to be left vacant to enable pedestrian, automobile, or other urban transport. Thus, the system can calculate positions for the set of air purification devices to which the set of air purification devices may be realistically deployed.

Additionally, the system can receive as input a set of device characteristics representing properties of the set of air purification devices to be deployed to the target space. For example, the system can receive a flow rate, a pollutant removal rate, and a device geometry (including input and output vents) in order to accurately simulate the effect of each device positioned in the target space on the time-dependent pollutant distribution in the target space. Thus, the system can position multiple types of air purification devices between deployments and/or within one deployment.

3. System

Figure 2:
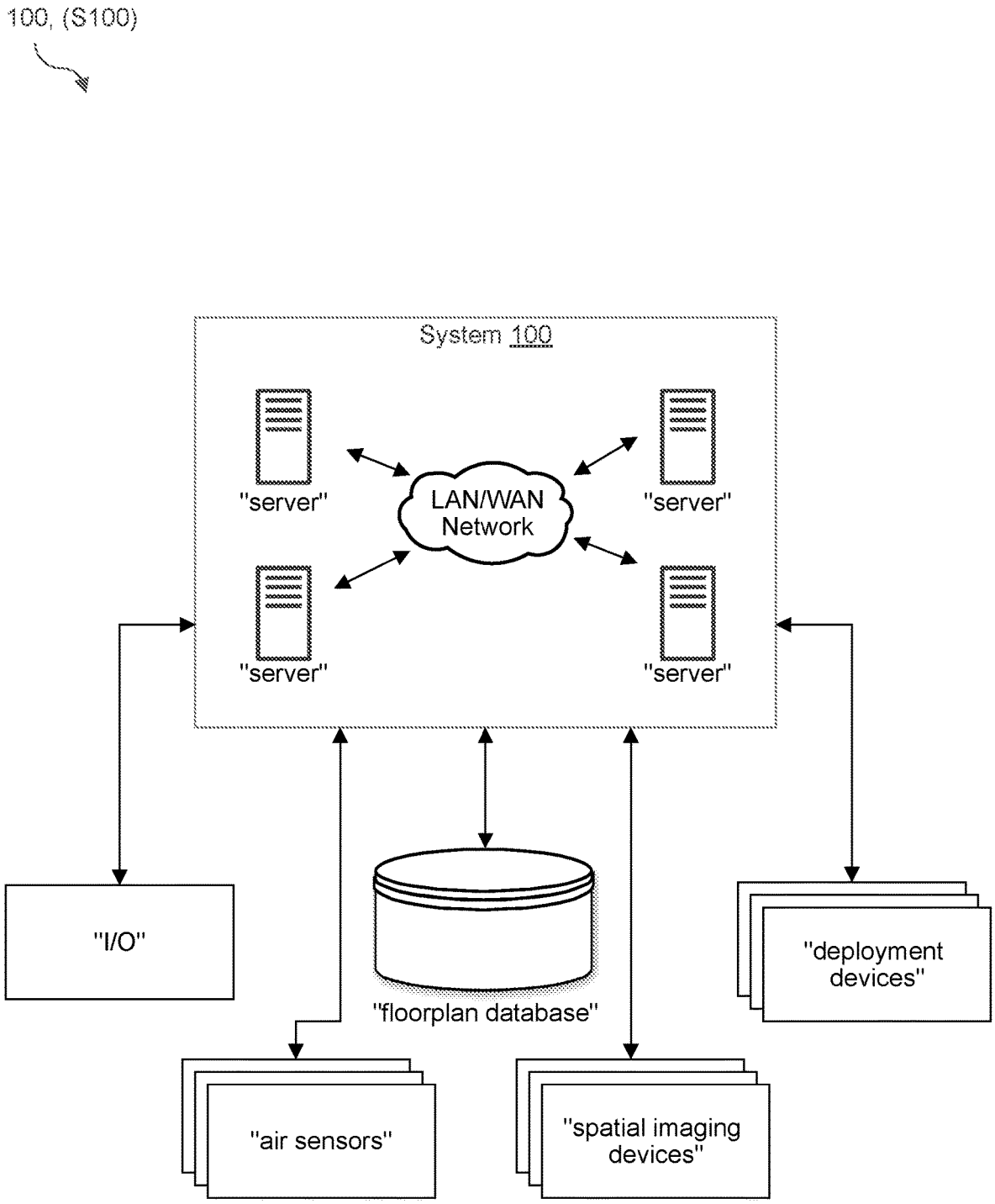
FIG. 2 is a schematic representation of a system.

As shown in FIG. 2, the method S100 is executed by a system 100 in direct or indirect communication with a set of air sensors, a set of spatial imaging devices, a floorplan database, and/or a set of deployment devices. More specifically, the system 100 can communicate with the set of air sensors, the set of spatial imaging devices, and the set of deployment devices over a local or wide area network. Additionally or alternatively, the system 100 can access relevant data stored internally or received as manual input via an I/O interface. Thus, the system 100 is configured to execute any Steps of the method S100 involving accessing data.

In one implementation, the system 100 includes multiple computers or servers performing Steps of the method S100 separately prior to subsequent data aggregation and further processing. For example, the system 100 can execute the simulation and calculation Steps of the method S100 at distinct physical devices. Alternatively, all or any subset of the Steps of the method S100 can be executed at the same physical devices of the system 100. Thus, the system 100 can include any number of physical computational devices in communication with one another.

4. Air Purification Devices

Generally, the system 100 executes the method S100 to position or deploy a set of air purification devices with a target space. More specifically, the system 100 can position air purification devices capable of removing one or more types of pollutants from inlet air including but not limited to: airborne particulate matter (e.g., PM10, PM2.5, or Ultrafine particles), volatile organic compounds (e.g., formaldehyde, benzene, toluene, xylene, ethylene glycol), greenhouse gasses (e.g., carbon dioxide, methane, nitrous oxide, chlorofluorocarbons), or any other air pollutant. Thus, the system 100 can improve the efficacy of a deployment of air purification devices in removing a large variety of pollutants by positioning the set of air purification devices advantageously within a target space.

The system 100 can position or deploy a set of air purification devices based on the characteristics of these air purification devices including: physical characteristics such as the dimension of each air purification device, the position of air inlets and air outlets on the air purification device, and additional technical specification of the air purification device further described below. Additionally, in one implementation, the system 100 can position or deploy multiple types of air purification devices within one deployment. Thus, the system 100 executes characteristics positioning and deployment of the set of air purification devices.

5. Spatial Representation

Figure 3:
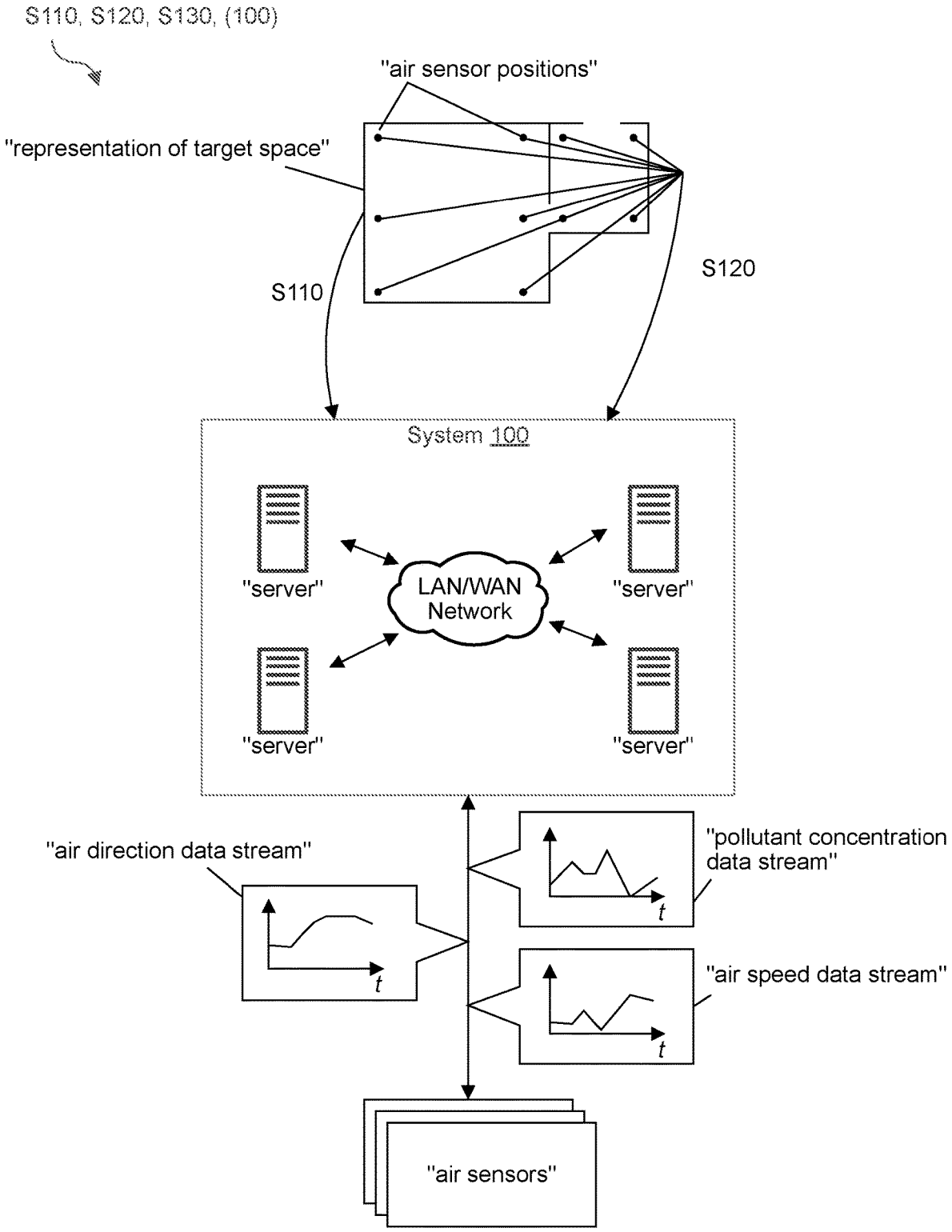
FIG. 3 is a flowchart representation of one variation of the method.

As shown in FIG. 3, the system 100 accesses a spatial representation of a target space (or "target space") for the deployment of the set of air purification devices. More specifically, the system 100 can access a three-dimensional void volume representing the volume of air within the target space in Step S110. The system 100 can access three-dimensional representations, including solid features within the void volume, such as: support columns machinery, road furniture, buildings, or any other solid object within the target space. Alternatively, the system 100 can access a floorplan or another two-dimensional representation of the target space from the floorplan database and generate a three-dimensional representation of the target space from the floorplan or two-dimensional representation of the space by accessing, or receiving as input, additional data such as ceiling height data. Additionally, the system 100 can access a representation of the target space labeled with the location of features, such as the location of doors, emergency exits, safety zones, electrical outlets, streets, which may limit possible positions for the set of air purification devices. Furthermore, the system 100 can access a representation of the target space including internal HVAC ducting or ventilation ducting to better simulate airflow within the target space. Thus, the system 100 can access a representation of the target space that enables the system 100 to simulate the pollutant distribution within the target space and to efficiently position or deploy air purification devices within the target space.

In one implementation, the system 100 can access a representation of a target indoor space, such as a manufacturing facility, factory, warehouse, laboratory, or any other high-volume indoor space within which air pollution is present. In this implementation, the system 100 accesses a three-dimensional void volume representing the target indoor space that is primarily enclosed by walls. However, the system 100 can access indoor spaces with both closed and open borders. For example, the system 100 can access a three-dimensional void volume representing a factory with a ventilation port represented by an open border. Thus, the system 100 can leverage the representation of the target indoor space to address indoor air pollution.

In another implementation, the system 100 can access a representation of a target outdoor space, such as a city street, a city block, a tunnel, a roadway, or any other outdoor space within which air pollution is present. In this implementation, the system 100 accesses a three-dimensional void volume representing the target outdoor space that includes at least one open border. For example, the system 100 can access a three-dimensional void volume of a street including an open border above the street (i.e., the "ceiling" of the void volume). Thus, the system 100 can leverage the representation of the target outdoor space to address outdoor air pollution.

5.1 Computer Vision

In one implementation, the system 100 can access a set of images, LIDAR data, and/or a 2D representation of the target space and generate the three-dimensional representation of the target space. More specifically, the system 100 can access a set of images of the target space; and reconstruct a representation of the target space based on the set of images of the target space and a computer vision algorithm. In particular, the system 100 can execute geometry-based computer vision algorithms such as stereo vision algorithms, structure from motion algorithms, and LIDAR- or point-cloud-based algorithms. Additionally, the system 100 can use floorplans and other available two-dimensional maps of the target space to inform the above-described algorithms. In one example of this implementation, the system 100 receives spatial data from previously deployed imaging devices within the target space, such as a LIDAR device or a multi-directional or mobile imaging device. Thus, the system 100 can flexibly generate a three-dimensional representation of the target space based on multiple types of spatial representation.

6. Air Sensors

As shown in FIG. 3, the system 100 can access parameter data streams from multiple types of air sensors operating within the target space during an observation period as well as a set of air sensor positions representing the position of the air sensors within the target space during the observation period. More specifically, the system 100 can access a set of air sensor positions within the representation of the target space corresponding to a set of air sensors positioned within the target space in Step S120. Thus, when accessing air data from within the target space, the system 100 can contextualize this data within the target space and inform computational fluid dynamic and/or machine learning models utilized to simulate pollution dynamics within the space.

In one implementation, the system 100 can access a set of air sensor positions representing multiple types of air sensors, such as air speed and air direction sensors, pollutant concentration sensors (for multiple species of air pollutants), barometric sensors, temperature sensors, humidity sensors, or any combination of the aforementioned sensors (i.e., multifunctional air sensors).

7. Parameter Data Streams

As shown in FIG. 3, the system 100 can access air movement and pollutant data from within the target space recorded by a set of air sensors within the target space. More specifically, the system 100 can access a set of observed parameter data streams in Step S130. In particular, the system 100 can access a set of observed parameter data streams recorded by the set of air sensors during an observation period, the set of observed parameter data streams including a set of pollutant concentration data streams, a set of air speed data streams, and a set of air direction data streams. Additionally, the system 100 can access a set of observed parameter streams including a set of humidity data streams, a set of temperature data streams, and/or a set of pressure data streams. Thus, to calculate effective positions for the set of air purification devices, the system 100 leverages real air data from within the space in the form of parameter data streams.

Generally, the system 100 can access parameter data streams in the form of a time series of data points collected during the observation period. Additionally, the system 100 can access parameter data streams in the form of a summary statistic (e.g., mean, median, mode) of the data collected during the observation period. Furthermore, the system 100 can access parameter data streams as a combination of time series and summary statistics data points for different types of data collected during the observation period. For example, the system 100 can access pollutant concentration data streams as a times series of data points and access air speed data streams and air direction data speed as a summary statistic of data collected during the observation period. Thus, by accepting parameter data streams in multiple forms, the system 100 can flexibly process data collected from the target space during the observation period.

In one implementation, the system 100 can access a set of observed parameter data streams, including particulate matter concentration data streams. More specifically, the system 100 can access the set of observed parameter data streams recorded by the set of air sensors during the observation period, the set of observed parameter data streams including: a set of particulate matter concentration data streams, a set of air speed data streams, and a set of air direction data streams. In this implementation, the system can access particulate matter concentration data streams that represent the concentration of PM2.5, PM10, and/or ultrafine particulate matter within the target space and during the observation period. Additionally or alternatively, the particulate matter concentration data streams can include data characterizing the particulate matter distribution within the target space. Thus, the system 100 is capable of simulating and positioning air purification devices according to the observed distribution of particulate matter within the target space.

In another implementation, the system 100 can access a set of observed parameter data streams, including greenhouse gas concentration data streams. More specifically, the system 100 can access the set of observed parameter data streams recorded by the set of air sensors during the observation period, the set of observed parameter data streams including: a set of greenhouse gas concentration data streams, a set of air speed data streams, and a set of air direction data streams. In particular, the system 100 can access the set of observed parameter data streams recorded by the set of air sensors during the observation period, the set of observed parameter data streams including: a set of carbon dioxide concentration data streams, a set of air speed data streams, and a set of air direction data streams. In this implementation, the system 100 can access greenhouse gas concentration data streams that represent the concentration of carbon dioxide, methane, nitrous oxide, chlorofluorocarbons, and/or any other greenhouse gas within the target space and during the observation period. Thus, the system 100 is capable of simulating and positioning air purification devices according to the observed distribution of greenhouse gasses within the target space.

In yet another implementation, the system 100 can access a set of observed parameter data streams, including volatile organic compound concentration data streams. More specifically, the system 100 can access the set of observed parameter data streams recorded by the set of air sensors during the observation period, the set of observed parameter data streams including: a set of volatile organic compound concentration data streams, a set of air speed data streams, and a set of air direction data streams. In this implementation, the system 100 can access volatile organic compound concentration data streams that represent the concentration of formaldehyde, benzene, toluene, xylene, ethylene glycol, or any other volatile organic compound within the target space and during the observation period. Thus, the system 100 is capable of simulating and positioning air purification devices according to the observed distribution of volatile organic compounds within the target space.

8. Boundary Conditions

Figure 4:
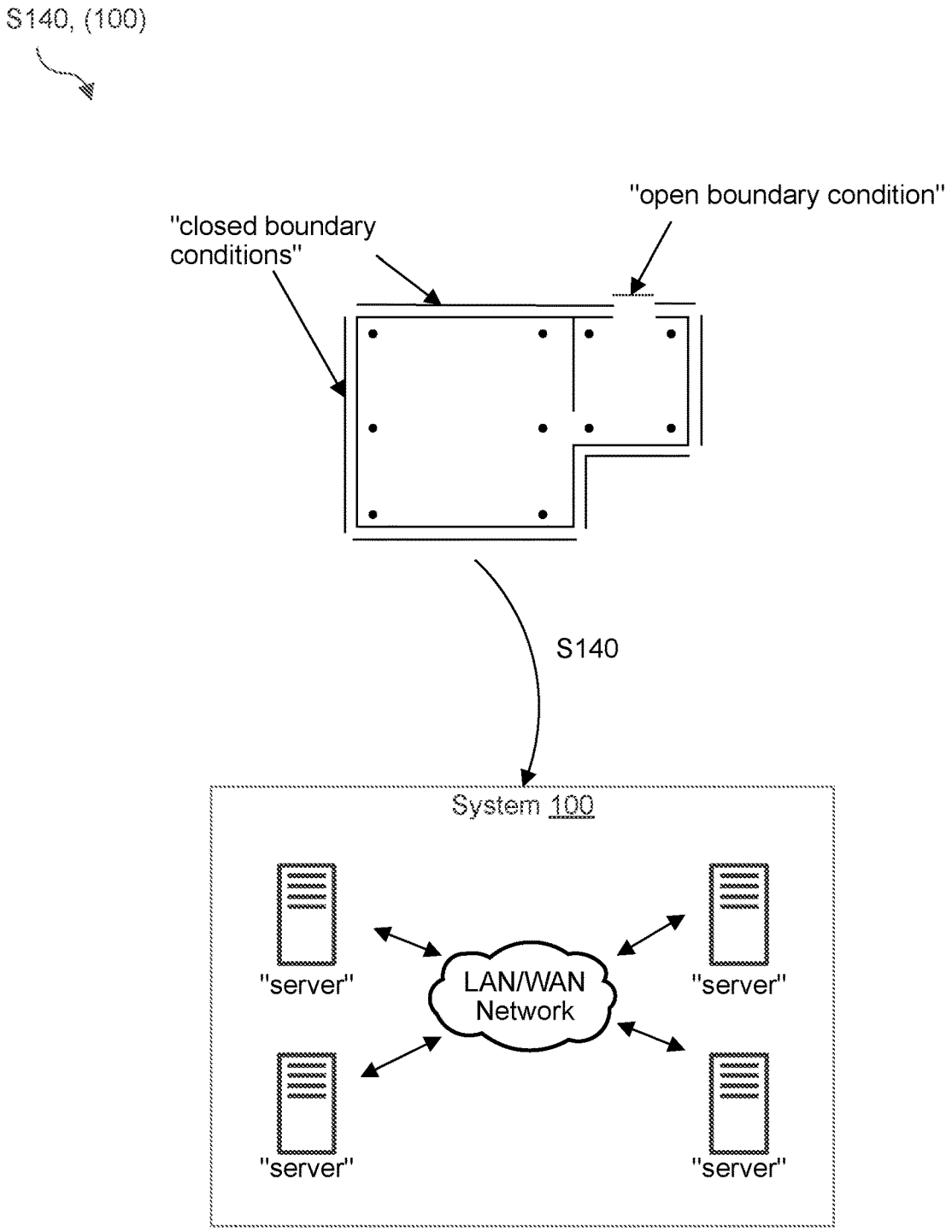
FIG. 4 is a flowchart representation of one variation of the method

As shown in FIG. 4, the system 100 can access a set of boundary conditions for the representation of the target space in Step S140. More specifically, the system 100 can access a set of boundary conditions for the three-dimensional void volume representing the target space. In particular, the system 100 can access a set of boundary conditions for the three-dimensional representation of the target space including: a set of pressure boundary conditions for open boundaries of the three-dimensional void volume; and a set of wall boundary conditions for closed boundaries of the three-dimensional void volume. Thus, the system 100 can accurately simulate pollution dynamics at the edge of the three-dimensional void volume representing the target space.

Generally, the system 100 can access pressure boundary conditions corresponding to open boundaries of the three-dimensional void volume representing the target space. For example, in outdoor applications of the method S100, the system 100 can access pressure boundary conditions for boundaries at the end of a section of road or at the top boundary of the three-dimensional void volume. The system 100 can access wall boundary conditions corresponding to closed boundaries of the three-dimensional void volume representing the target space. Thus, the system 100 access boundary conditions that enable the system 100 to accurately simulate pollution dynamics within the target space that interacts with external environmental conditions outside of the target space.

In one implementation, the system 100 can automatically assign boundary conditions to a three-dimensional void volume representing a target space based on a floorplan representation of the target space or another form of map representing the target space. Thus, the system 100 can access a three-dimensional void volume representing the target space that is not labeled with boundary conditions and can assign boundary conditions prior to simulation.

9. Simulation

Figure 5A:
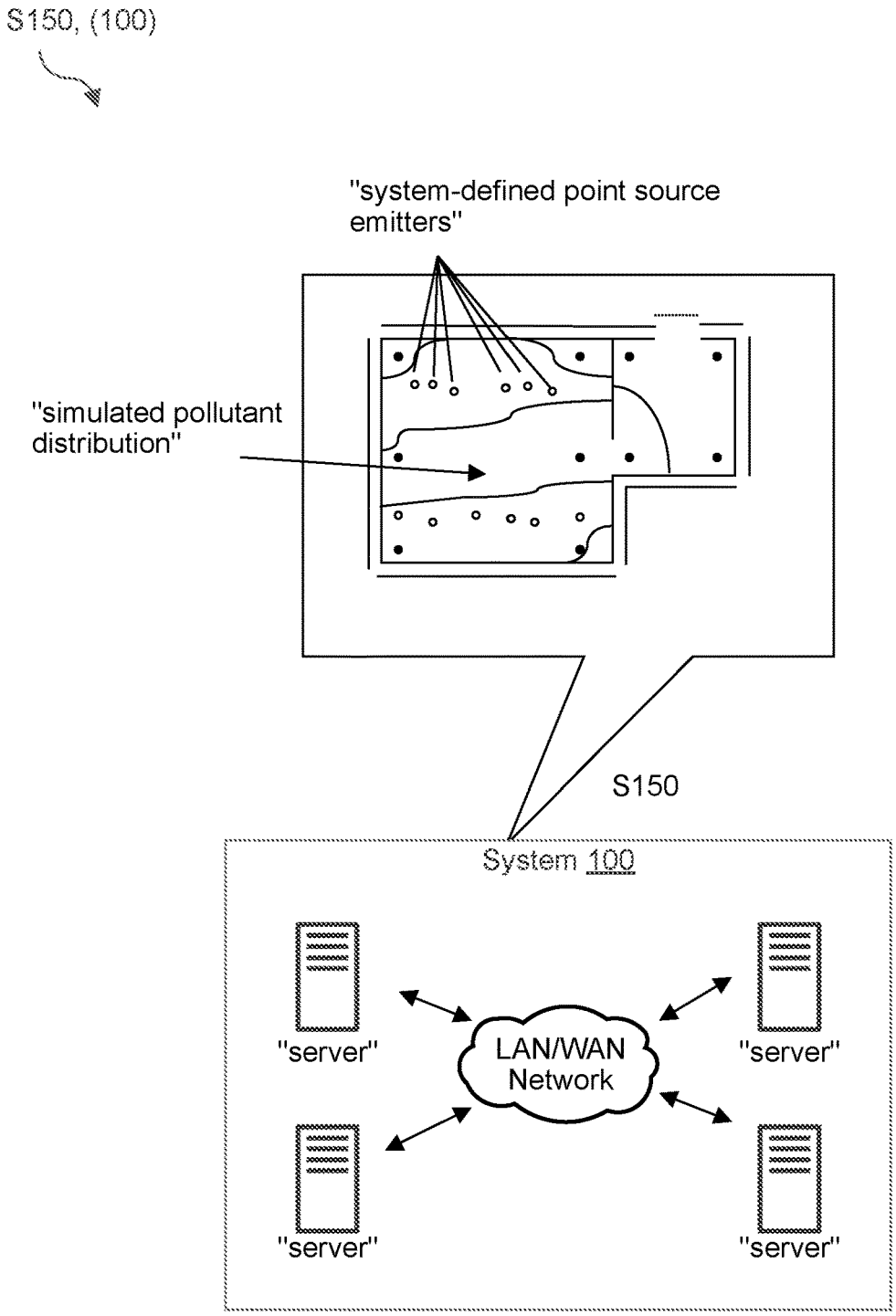
FIG. 5A is a flowchart representation of one variation of the method.
Figure 5B:
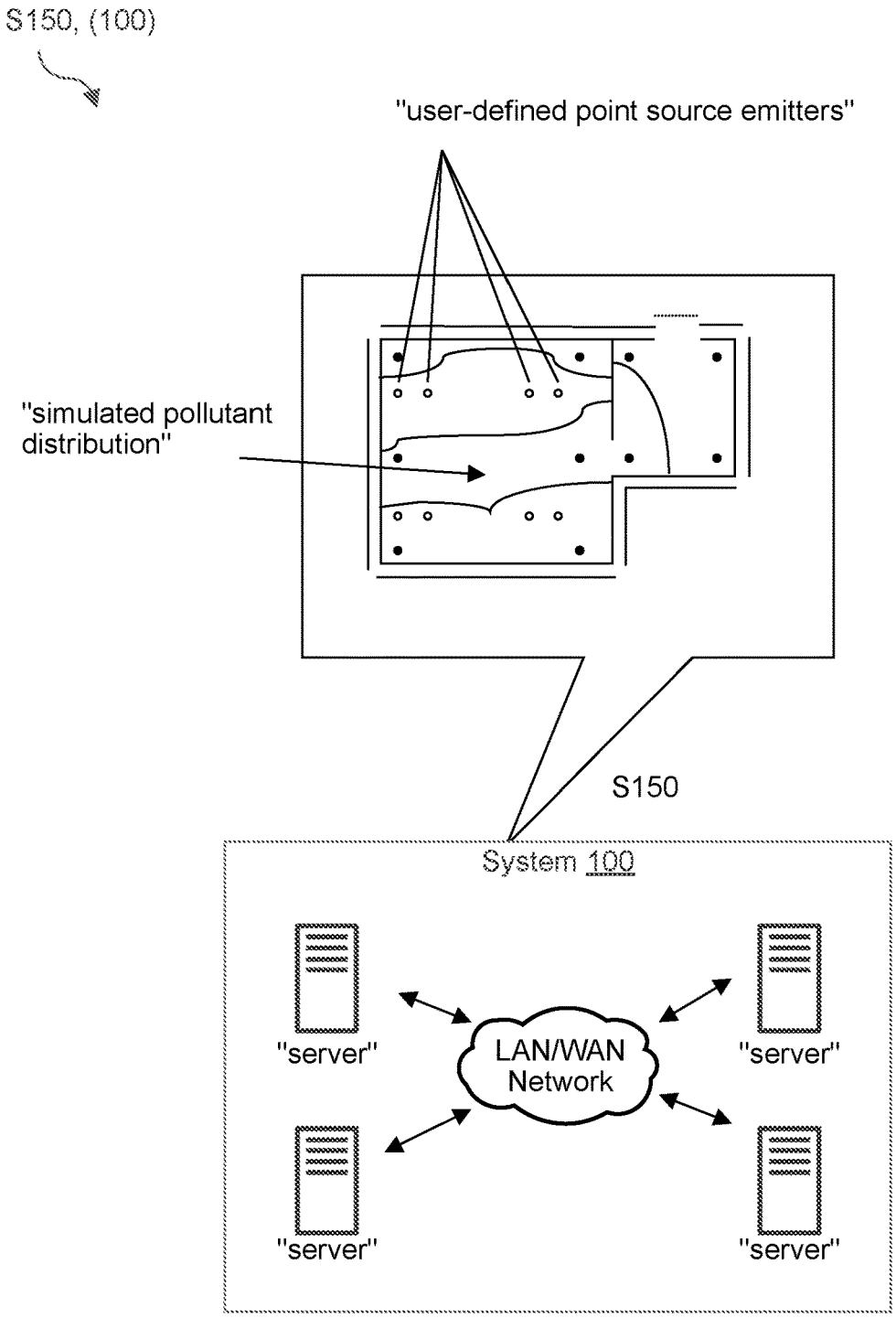
FIG. 5B is a flowchart representation of one variation of the method.

As shown in FIGS. 5A and 5B, the system 100 can simulate pollution dynamics within the representation of the target space based on the parameter data streams from the set of air sensors in order to efficiently position air purification devices within the space in subsequent Steps of the method S100. More specifically, the system 100 can simulate a distribution of a pollutant in the three-dimensional representation of the target space that minimizes error relative to the set of parameter data streams based on the set of air sensor positions, the set of parameter data streams, and the set of boundary conditions in Step S150. In particular, the system 100 can reproduce the observed parameter data streams via simulation by executing computational fluid dynamics or machine learning models to minimize error between simulated pollutant data and the observed pollutant data streams. Thus, the system 100 simulates a pollutant distribution that best describes the observed data within the target space.

Generally, to simulate a pollutant distribution within the representation of the target space, the system 100 defines a mesh over the representation of the target space. The system 100 can define a mesh that includes the set of air sensor positions as points within the mesh, at which the system 100 calculates a set of simulated parameter data streams based on the simulated pollutant distribution. Thus, the system 100 can minimize the difference (based on a difference function and minimization algorithm) between the simulated parameter data streams and the observed parameter data streams.

When defining a mesh over the representation of the target space, the system 100 can increase the density (or resolution) of the mesh around higher-complexity geometric features, likely sources of pollution introduction, and/or proximal to the set of air sensor positions defined within the representation of the target space. Thus, the system 100 can utilize an adaptive mesh resolution when simulating the pollutant distribution over the target space.

As shown in FIG. 5A, the system 100 can define a set of point source pollutant emitters (i.e., system-defined point source emitters) within the target space that minimizes the error between the set of observed parameter data streams and the set of simulated pollutant data streams. In this implementation, the system 100 can access a predetermined number of point source pollutant emitters to estimate within the target space. The system 100 can then minimize the difference between the observed parameter data streams and the simulated parameter data streams by solving for the position and magnitude of the pollutant emitted from each point source pollutant emitter in the set of point source pollutant emitters. Alternatively, as shown in FIG. 5B the system can access a set of pollutant point source emitter positions within the representation of the target space in addition to a number of pollutant point source emitters (i.e., user-defined point source emitters). In this implementation, the system 100 can solve for the rate of pollutant emission from each point source pollutant emitter in the set of pollution point source emitters. Thus, the system 100 can estimate the positions within the target space from which pollutants are being emitted if said positions are unknown, or the system 100 can access the positions of known pollutant sources within the target space to reduce the computational resources consumed by the simulation.

In one implementation, the system 100 can simulate a distribution of the pollutant within the target space based in part on a computational fluid dynamic algorithm. More specifically, the system 100 can: calculate a time-dependent or time-invariant rate of pollutant emission for each point source pollutant emitter in the set of point source pollution emitters, the time-dependent or time-invariant rate of pollutant emission for each point source pollutant emitter in the set of point source pollution emitters resulting in a set of simulated parameter data streams characterized by minimal error relative to the set of observed parameter data streams, wherein the calculation is based on the set of air sensor positions, the set of boundary conditions, and a computational fluid dynamic model. The system 100 executes the computational fluid dynamic model based on the mesh projected over the representation of the space. Additionally, the system 100 can execute multiple types of computational fluid dynamic models including, but not limited to, large eddy simulation, direct numerical simulation, Reynolds-averaged Navier-Stokes simulation, or a combination of these models. Furthermore, the system 100 can execute Lagrangian models and/or Eulerian models to simulate the distribution of airborne particulate matter within the target space.

In another implementation, the system 100 can simulate a distribution of the pollutant within the target space based in part on a machine learning algorithm. More specifically, the system 100 can: calculate a time-dependent or time-invariant rate of pollutant emission for each point source pollutant emitter in the set of point source pollution emitters, the time-dependent or time-invariant rate of pollutant emission for each point source pollutant emitter in the set of point source pollution emitters resulting in a set of simulated parameter data streams characterized by minimal error relative to the set of observed parameter data streams, wherein the calculation is based on the set of air sensor positions, the set of boundary conditions, and a machine learning model. The system 100 can train and/or execute machine learning models that mimic the output of computational fluid dynamic models. For example, the system 100 can train and/or execute a convolutional neural network based on a set of training examples including a set of input meshes representing a set of void volumes, a set of input parameter data streams, and a set of output pollutant distributions. In this example, the system 100 can execute the trained convolutional neural network in order to generate a pollutant distribution in a significantly shorter period of time than more computationally intensive computational fluid dynamic models.

In yet another implementation, the system 100 can simulate a time-dependent or transient distribution of the pollutant within the target space. Although, the system 100 consumes more computational resources during Step S150 in this implementation, by simulating a time-dependent distribution of the pollutant, the system 100 can identifying periods of maximum pollutant introduction within the target space as well as temporal variations or patterns in pollution concentration within the target space, which can further inform the calculation of the set of device positions for the target space.

In an alternative implementation, the system 100 can simulate a steady-state or time-invariant distribution of the pollutant within the target space. In this implementation, the system 100 reduces consumption of computational resources relative to the time-dependent implementation of Step S150, enabling faster calculation of positions for the set of purification devices. However, in this implementation, the system 100 may not generate as accurate a pollutant distribution relative to the time-dependent implementation.

In these implementations, the term "minimal error" refers to a difference function calculated based on the set of observed parameter data streams and the set of simulated parameter data streams. In each of the above-described implementation, the system 100 attempts to calculate rates and/or positions of pollution introduction within the representation of the target space that result in a set of simulated parameter data that are as close as possible (i.e., are characterized by minimal error) relative to the observed parameter data streams.

When simulating the distribution of the pollutant over the representation of the target space, the system 100, can identify repetitive geometry within the representation of the target space and select a single instance of the repetitive geometry for simulation. Likewise, when simulating a time-dependent pollutant distribution in the representation of the target space, the system 100 can identify temporal patterns (e.g., daily patterns within a manufacturing facility or daily traffic patterns on a street) and terminate the simulation prior to simulating multiple instances of the same temporal pattern. In one example of this implementation, the system 100 can access temporal information associated with the space, such as working hours within the facility, manufacturing cycles, traffic cycles, etc., and evaluate whether pollution patterns are consistent over multiple instances of the same cycle. The system 100 can then terminate the simulation after identifying sufficiently similar consecutive cycles. Additionally or alternatively, the system 100, during simulation of the pollutant distribution in the target space, can identify local vortices, recirculation zones, and/or dead zones within which pollutants may collect over time without a change in the airflow within the space. The system 100 can then position an air purification device within these zones to remove pollutants concentrated within the zone and/or eliminate the recirculation pattern altogether by changing airflow in the zone.

The system 100 integrates air speed and air direction data streams into the simulation of the pollutant distribution by setting the air speed and direction at each air sensor position in the set of air sensor positions equal to the observed air speed and air direction at that location. Thus, the system 100 can accurately simulate the air speed and air direction, which will influence the calculated pollutant distribution within the representation of the target space. Additionally, the system 100 can integrate humidity data streams and temperature data streams into the simulation of the pollutant distribution. In this implementation, the system 100 can: set the humidity and temperature values at the location of the set of air sensors equal to the humidity and temperature data streams; and calculate a temperature and/or a humidity distribution within the target space. Thus, the system 100 can subsequently identify regions of the target space that may not be suitable for deployment of the set of air purification devices due to operational constraints on humidity and temperature.

10. Device Characteristics

Figure 6:
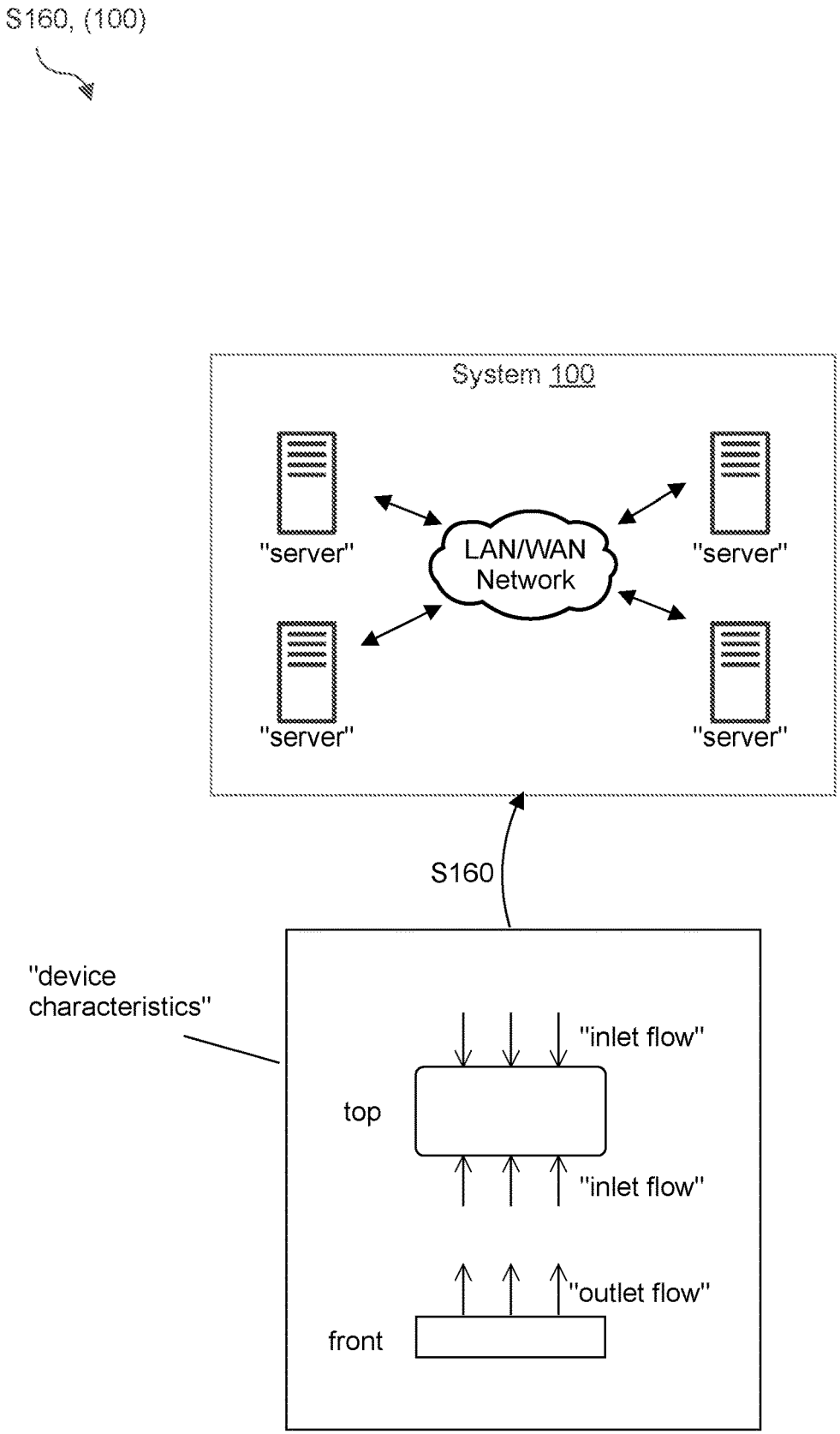
FIG. 6 is a flowchart representation of one variation of the method.

As shown in FIG. 6, the system 100 can access a set of device characteristics for the set of air purification devices to be deployed within the target space in Step S160. More specifically, the system 100 can access a set of device characteristics for the set of air purification devices to be deployed within the target space, wherein the set of device characteristics include: a pollutant removal rate, an air inlet flow rate, an air inlet flow direction, an air outlet flow rate, an air outlet flow direction, and a physical model of an air purification device in the set of air purification devices. Additionally, the system 100 can access device characteristics including temperature-related and/or humidity-related operational constraints and/or other operational constraints for the set of air purification devices. Thus, the system 100 can access device characteristics that enable accurate simulation of the impact of each air purification device in the set of air purification devices on the simulated pollutant distribution in the representation of the target space.

In one implementation, the system 100 can access multiple sets of device characteristics, each set of device characteristics corresponding to a distinct type of air purification device to be deployed in the target space. Thus, in this implementation, the system 100 can accurately simulate the impact of multiple types of air purification devices on the pollutant distribution in the target space.

In another implementation, the system 100 can access a set of device characteristics that includes a detailed three-dimensional model of an air purification device in the set of air purification devices including: the location, size, orientation, and associated flow direction of inlet and outlet vents. In this implementation, the system 100 can utilize the set of device characteristics, including the detailed three-dimensional model to position the air purification devices at positions and orientations favorable to the reduction of pollutants within the target space.

11. Spatial Constraints

Figure 7:
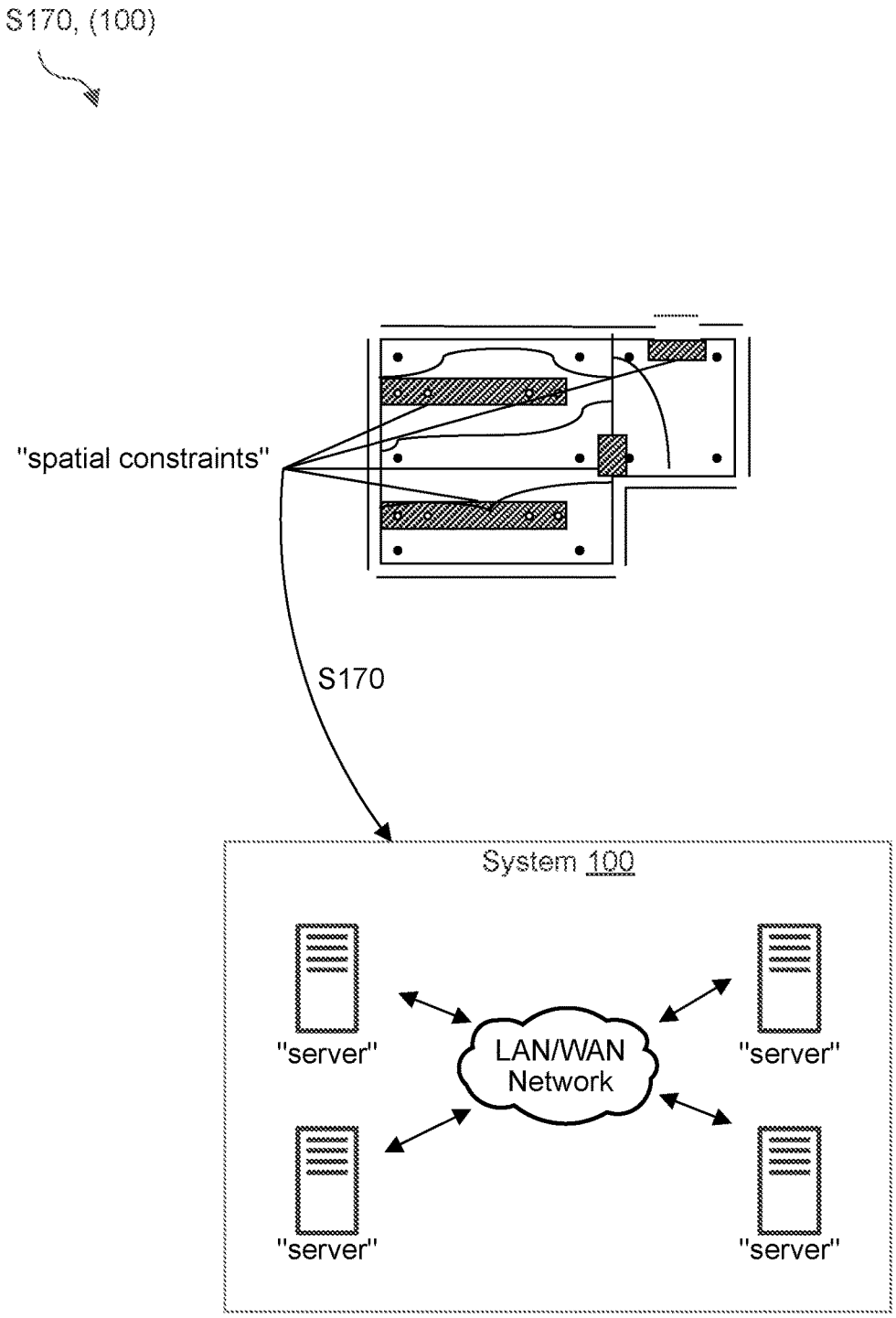
FIG. 7 is a flowchart representation of one variation of the method.

As shown in FIG. 7, the system 100 can access a set of spatial constraints for the set of air purification devices to be deployed in the target space in Step S170. More specifically, the system 100 can access spatial constraints based on electrical outlet availability (i.e., regions of target space where sufficient electrical power cannot be delivered to an air purification device in the set of air purification devices), structural limitations of the target space (i.e., regions of the target space that cannot support the structural load of an air purification device in the set of air purification devices), safety regions (i.e., regions of the target space that must be left vacant for safety purposes), non-functional regions (e.g., regions in the target space where an air purification device in the set of air purification devices cannot operate due to insufficient ventilation, high heat, etc.). Thus, the system 100 defines a region of the target space within which the set of air purification devices may be positioned.

In one implementation, the system 100 can access a spatial constraint for air purification devices in the representation of the target space based on electrical power availability in the target space. For example, in implementations of the method S100 in which the target space is an outdoor space such as a street or city block, the system 100 can access a set of spatial constraints that define regions where electrical power is accessible on the street level such as within a predetermined radius of street lamp positions within the target space.

12. Device Position Calculation

Figure 8A:
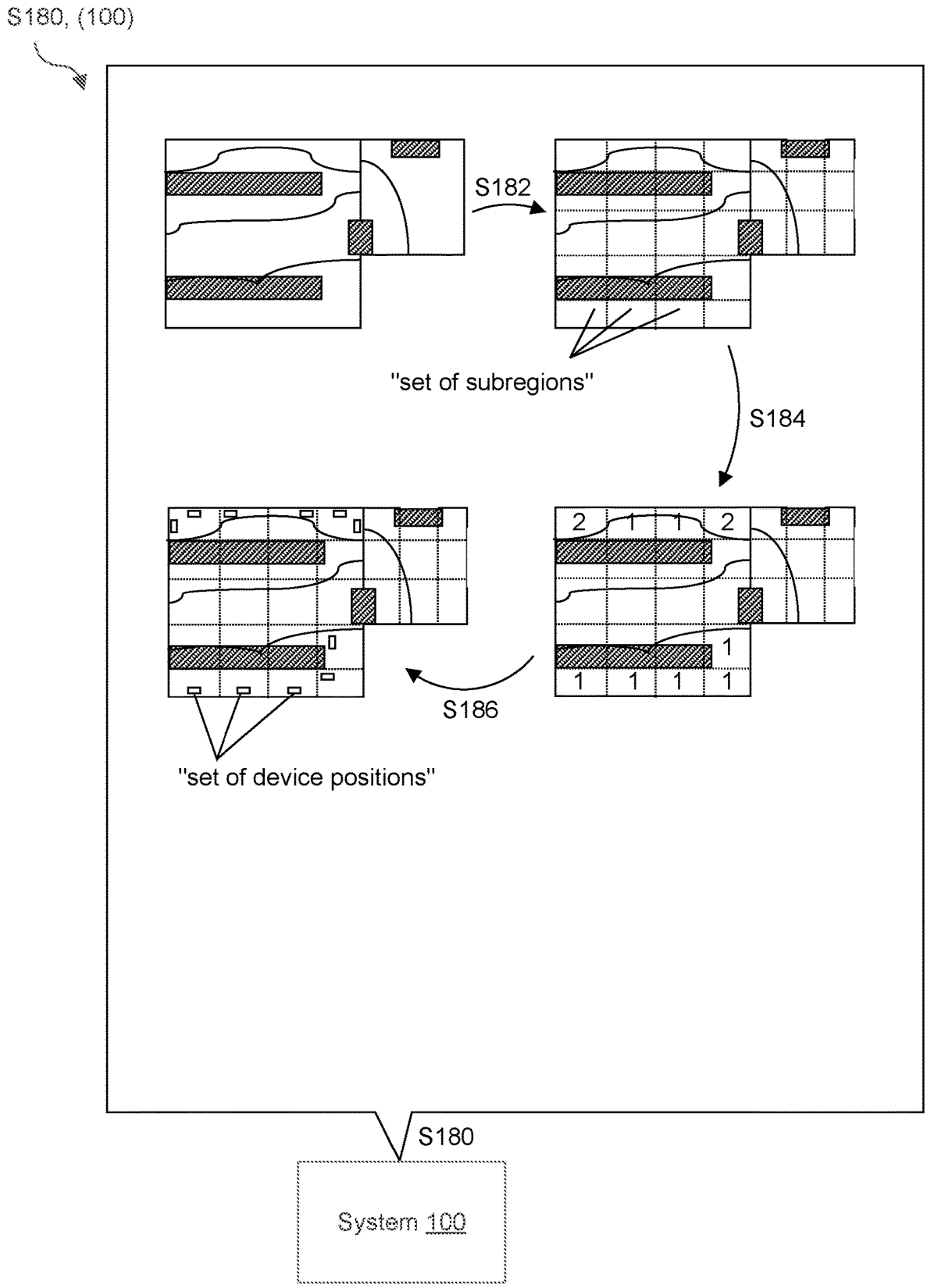
FIG. 8A is a flowchart representation of one variation of the method.
Figure 8B:
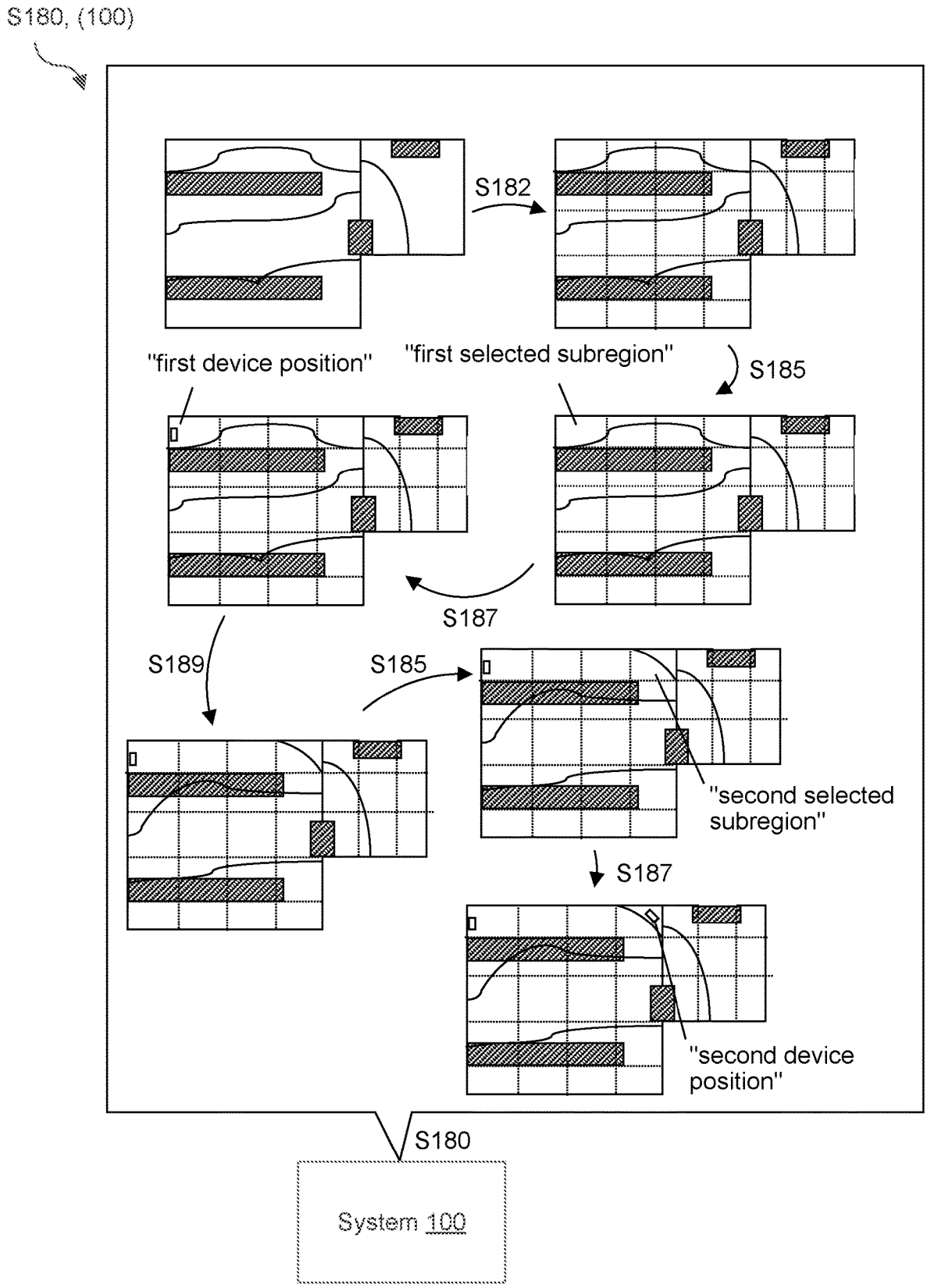
FIG. 8B is a flowchart representation of one variation of the method.

As shown in FIGS. 8A and 8B, the system 100 can calculate a set of device positions for the set of air purification devices within the target space such that a corresponding deployment of air purification devices effects an air quality goal for the target space. More specifically, the system 100 can calculate a set of device positions in the representation of the target space based on the distribution of the pollutant, the spatial constraint for air purification devices, and the set of device characteristics in Block S180. The system 100 can execute this calculation via multiple air purification device allocation algorithms further described below to distribute air purification devices throughout the target space to reduce the amount of air pollutants within the target space.

Generally, the system 100 can define, via input from a user or automatically, a set of subregions within the representation of the target space in Step S182 shown in FIGS. 8A and 8B. In one example, a user defines a set of subregions in the target space and inputs the positions of these subregions to the system. In an alternative example, the system 100 automatically defines the set of subregions based on features of the representation of the target space. In this example, the system 100 can access a target subregion volume and define subregions such that each subregion is characterized by a volume approximating the target subregion volume. Additionally or alternatively, the system 100 can automatically define subregions according to the geometry of the representation of the target space. In another alternative example implementation, the system 100 can define subregions based on air flux patterns extracted from a computational fluid dynamic simulation of the target space. In this example, the system 100 can automatically define borders between subregions along planes characterized by local minima in the air flux patterns within the representation of the target space.

Additionally, the system 100 can continue to calculate positions of air purification devices in the set of air purification devices within the representation of the target space until the system 100 achieves a target pollutant reduction goal. For example, the system 100 can access a target pollutant reduction goal expressed as a proportion of existing pollution within the target space (e.g., 50% pollutant reduction). Additionally or alternatively, the system 100 can access a target pollutant reduction goal expressed as a maximum allowable concentration of a pollutant (e.g., AQI less than 100). Thus, the system 100 can continue calculating positions for air purification devices in the set of air purification devices until the system 100 calculates that it is likely to achieve the target pollutant reduction goal.

As shown in FIG. 8A, the system 100 can calculate positions by calculating a pollution introduction rate or pollutant concentration within each subregion in the set of subregions within the representation of the target space based on the previously calculated pollutant distribution. In this implementation, the system 100 can calculate a number of air purification devices in the set of air purification devices for positioning within each subregion in the set of subregions based on the pollution introduction rate or pollutant concentration for that subregion and based on the target pollutant reduction rate in Step S184. For example, the system 100 can calculate a pollution introduction rate for a first subregion equal to four times the pollution removal rate of an air purification device in the set of air purification devices. In this example, the system 100 can allocate two air purification devices to the subregion to achieve a target pollutant reduction goal of 50%. In this implementation, the system 100 can allocate air purification devices to each of the subregions in the set of subregions based on the target pollutant reduction goal and the pollution introduction rate of each subregion in the set of subregions. Upon allocating a specific number of air purification devices to each subregion of the target space, the system 100 can position individual air purification devices within each subregion based on the set of spatial constraints and the set of device characteristics in Step S186. More specifically, the system 100 can calculate positions for air purification devices within each subregion at orientations and positions that prevent the inlet and outlet vents of the air purification devices from being obstructed by the geometry of the representation of the space. Additionally, the system 100 can: access device characteristics including temperature- and humidity-related operational constraints for the set of air purification devices; and calculate positions that ensure efficient and safe operation of the set of air purification devices (e.g., outside of regions of the target space predicted to be characterized by excessive temperature or humidity). The system 100 can also access temperature-, humidity-, and pollutant-concentration-based functions indicating the efficacy of the set of air purification devices. For example, the system 100 can access a function indicating efficacy of an air purification device based on humidity, temperature, and/or a pollutant concentration. Furthermore, the system 100 can: access the set of device characteristics including the flow rate, direction, and geometry of inlet and outlet streams for the set of air purification devices; and position the set of air purification devices such that the outlet flow of a first air purification device in the set of air purification devices does not intersect with the inlet flow of a second air purification device in the set of air purification devices. Thus, the system 100 can prevent redundant purification of an already clean outlet airflow, thereby improving the overall efficiency of the set of air purification devices.

In particular, the system 100 can: define a set of subregions within the representation of the target space; select a first subregion in the set of subregions characterized by a maximum concentration of the pollutant based on the time-dependent distribution of the pollutant; and calculate a first device position in the set of device positions within the first subregion satisfying the spatial constraint for the set of air purification devices and based on the set of device characteristics. Thus, the system 100 can continue allocating air purification devices to subregions of the target space based on the simulated pollution concentration in each subregion of the target space.

In one implementation, the system 100 can calculate positions for the set of air purification devices based on a single steady-state simulation of the pollutant distribution in the target space to minimize computational resources dedicated to executing the method S100. More specifically, the system 100 can simulate a steady-state distribution of the pollutant in the representation of the target space reproducing the set of observed parameter data streams based on the set of air sensor positions, the set of observed parameter data streams, and the set of boundary conditions; and calculate the set of device positions in the representation of the target space based on the steady-state distribution of the pollutant, the spatial constraint for air purification devices, and the set of device characteristics. Thus, the system 100 can position air purification devices within subregions of the target space according to the magnitude of the pollution introduction rate within each subregion of the target space.

In implementations of the method S100 in which the system 100 calculates a time-dependent pollutant concentration distribution, the system 100 can position air purification devices based on the maximum pollutant introduction rate or pollutant concentration throughout the simulated time-dependent pollutant distribution.

As shown in FIG. 8B, the system 100 can calculate positions for air purification devices by positioning each successive air purification device within a subregion in the set of subregions characterized by a maximum pollution introduction rate or pollutant concentration. In this implementation, the system 100 can then re-simulate the pollutant distribution based on the set of device positions already calculated for the target space. Upon simulating the impact of each device's position on the pollutant distribution in the target space, the system 100 can calculate a subsequent device position at an updated maximum pollutant concentration in the representation of the target space.

More specifically, the system can select a first subregion in the set of subregions characterized by a maximum concentration or maximum pollutant introduction rate of the pollutant based on the distribution of the pollutant in Step S185; calculate a first device position in the set of device positions within the first subregion satisfying the spatial constraint for the set of air purification devices and based on the set of device characteristics in Step S187; simulate an updated distribution of the pollutant in the representation of the target space based on the set of air sensor positions, the set of observed parameter data streams, the set of boundary conditions, the first device position, and the set of device characteristics in Step S189; select a second subregion in the set of subregions characterized by an updated maximum concentration of the pollutant based on the updated distribution of the pollutant in a second instance of Step S185; and calculate a second device position in the set of device positions within the second subregion satisfying the spatial constraint for the set of air purification devices and based on the set of device characteristics in a second instance of Step S187.

In one implementation, the system 100 can train and execute a machine learning model configured to predict the impact of a set of air purification devices' positions on the pollutant distribution of the space. In this implementation, the system 100 can train and execute a convolutional neural network to simulate the impact of an air purification device on a pollutant distribution based on a set of device characteristics associated with the air purification device. More specifically, the system 100 can simulate the updated time-dependent distribution of the pollutant in the representation of the target space via a machine learning model configured to simulate an impact of the first air purification device on the time-dependent distribution of the pollutant. Additionally, the system 100 can simulate the effect of each air purification device positioned within the space on air speed, air direction, air temperature, and/or air humidity, which may modify regions within the space in which the system 100 can position subsequent air purification devices. Thus, the system 100 can minimize the effect of successive simulations on computational time via utilization of the machine learning model. In this implementation, the system 100 can continue positioning air purification devices within the target space until the system 100 simulates that the cumulative impact of the set of air purification devices on the pollutant distribution in the target space satisfies the target pollutant reduction goal for the target space.

13. Deployment

In one variation, the system 100 can deploy the set of air purification devices to a set of locations in the target space corresponding to the set of device positions in Step S190. In this variation, the system 100 can transmit the set of device positions calculated in Step S180 to a set of deployment devices (e.g., such as a tablet computer, smartphone, or other devices), indicating to an installer the set of device positions. Thus, the system 100 can function to accurately deploy the set of air purification devices to the space in accordance with the set of device positions calculated during execution of the method S100.

14. Continuous Monitoring

Figure 9:
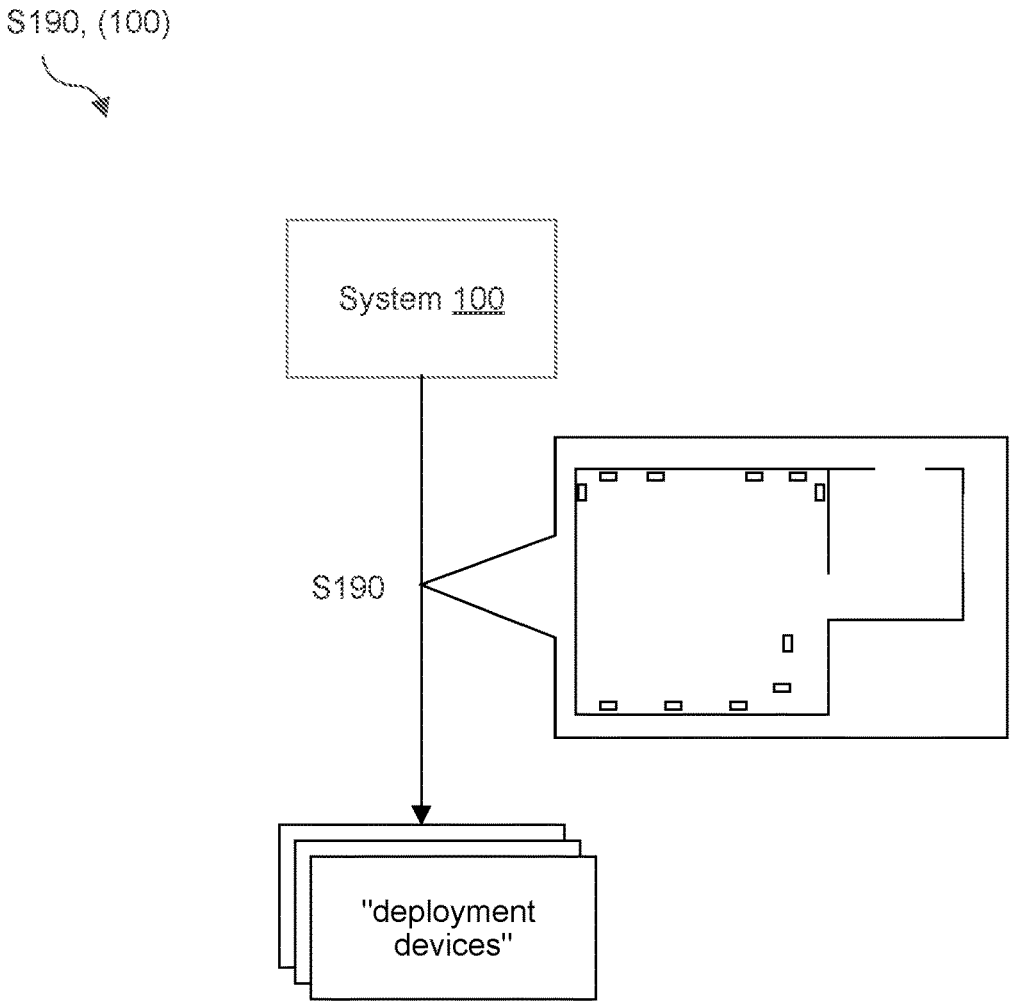
FIG. 9 is a flowchart representation of one variation of the method.

As shown in FIG. 9, in an implementation in which the set of air purification devices is configured with integrated air sensors, the system 100 can access a second set of parameter data streams recorded by the set of purification devices during a second observation period. In this implementation, the system 100 can compare the second set of parameter data streams with a simulated pollutant distribution in the target space based on the calculated set of device positions such that the simulated pollutant distribution represents the predicted pollutant distribution in the target space upon deployment of the set of air purification devices. In this implementation, if the second set of parameter data streams is characterized by greater than a threshold difference from the simulated pollutant distribution, the system 100 can execute a second instance of the method S100 in order to recalculate the set of device positions.

The systems and methods described herein can be embodied and/or implemented at least in part as a machine configured to receive a computer-readable medium storing computer-readable instructions. The instructions can be executed by computer-executable components integrated with the application, applet, host, server, network, website, communication service, communication interface, hardware/firmware/software elements of a user computer or mobile device, wristband, smartphone, or any suitable combination thereof. Other systems and methods of the embodiment can be embodied and/or implemented, at least in part, as a machine configured to receive a computer-readable medium storing computer-readable instructions. The instructions can be executed by computer-executable components integrated by computer-executable components integrated with apparatuses and networks of the type described above. The computer-readable medium can be stored on any suitable computer-readable media such as RAMs, ROMs, flash memory, EEPROMs, optical devices (CD or DVD), hard drives, floppy drives, or any suitable device. The computer-executable component can be a processor but any suitable dedicated hardware device can (alternatively or additionally) execute the instructions.

As a person skilled in the art will recognize from the previous detailed description and from the figures and claims, modifications and changes can be made to the embodiments of the invention without departing from the scope of this invention as defined in the following claims.

We claim:

1. A method for deploying a set of air purification devices in a target space comprising:

accessing a set of air sensor positions within a representation of the target space corresponding to a set of air sensors positioned within the target space;

at the set of air sensors, recording a set of observed parameter data streams comprising a set of pollutant concentration data streams of a pollutant, a set of air speed data streams, and a set of air direction data streams, each parameter data stream in the set of observed parameter data streams corresponding to an air sensor position in the set of air sensor positions;

simulating, via a model, a distribution of the pollutant in the representation of the target space reproducing the set of observed parameter data streams based on:

the set of air sensor positions; and the set of observed parameter data streams;

accessing a set of device characteristics for the set of air purification devices to be deployed within the target space, the set of device characteristics comprising:

a pollutant removal rate;

an air inlet flow rate;

an air inlet flow direction;

an air outlet flow rate;

an air outlet flow direction; and a physical model of an air purification device in the set of air purification devices; and calculating a set of device positions in the representation of the target space based on the distribution of the pollutant and the set of device characteristics.

2. The method of claim 1, wherein simulating, via the model, the distribution of the pollutant in the representation of the target space comprises simulating, via the model selected from a group of models, the distribution of the pollutant in the representation of the target space, the group of models consisting of:

a machine learning model; and a computational fluid dynamic model.

3. The method of claim 1, wherein the representation of the target space comprises a void volume.

4. The method of claim 1, wherein the target space comprises an indoor target space.

5. The method of claim 1, wherein the target space comprises an outdoor target space.

6. The method of claim 1, further comprising generating the representation of the target space.

7. The method of claim 1:

wherein, at the set of air sensors, recording the set of observed parameter data streams comprises, at the set of air sensors, recording the set of observed parameter data streams comprising:

the set of pollutant concentration data streams comprising a set of particulate matter concentration data streams;

the set of air speed data streams;

the set of air direction data streams;

a set of temperature data streams; and a set of humidity data streams;

wherein simulating, via the model, the distribution of the pollutant in the representation of the target space comprises simulating, via the model, the distribution of particulate matter in the representation of the target space reproducing the set of observed parameter data streams based on:

the set of air sensor positions; and the set of observed parameter data streams; and wherein calculating the set of device positions in the representation of the target space comprises calculating the set of device positions in the representation of the target space based on the distribution of particulate matter and the set of device characteristics.

8. The method of claim 1:

wherein, at the set of air sensors, recording the set of observed parameter data streams comprises, at the set of air sensors, recording the set of observed parameter data streams, the set of observed parameter data streams comprising:

the set of pollutant concentration data streams comprising a set of carbon dioxide concentration data streams;

the set of air speed data streams; and the set of air direction data streams;

wherein simulating, via the model, the distribution of the pollutant in the representation of the target space comprises simulating, via the model, the distribution of carbon dioxide in the representation of the target space reproducing the set of observed parameter data streams based on:

the set of air sensor positions; and the set of observed parameter data streams; and wherein calculating the set of device positions in the representation of the target space comprises calculating the set of device positions in the representation of the target space based on the distribution of carbon dioxide and the set of device characteristics.

9. The method of claim 1:

wherein, at the set of air sensors, recording the set of observed parameter data streams comprises, at the set of air sensors, recording the set of observed parameter data streams during the observation period, the set of observed parameter data streams comprising:

the set of pollutant concentration data streams comprising a set of volatile organic compound concentration data streams;

the set of air speed data streams; and the set of air direction data streams;

wherein simulating, via the model, the distribution of the pollutant in the representation of the target space comprises simulating, via the model, the distribution of a volatile organic compound in the representation of the target space reproducing the set of observed parameter data streams based on:

the set of air sensor positions; and the set of observed parameter data streams; and wherein calculating the set of device positions in the representation of the target space comprises calculating the set of device positions in the representation of the target space based on the distribution of the volatile organic compound and the set of device characteristics.

10. A method for deploying a set of air purification devices in a target space comprising:

accessing a set of air sensor positions within a representation of the target space corresponding to a set of air sensors positioned within the target space;

at the set of air sensors, recording a set of observed parameter data streams comprising a set of pollutant concentration data streams of a pollutant, a set of air speed data streams, and a set of air direction data streams, each parameter data stream in the set of observed parameter data streams corresponding to an air sensor position in the set of air sensor positions;

simulating, via a model, a distribution of the pollutant in the representation of the target space reproducing the set of observed parameter data streams by:

defining a set of point source pollutant emitters within the representation of the target space; and calculating a rate of pollutant emission for each point source pollutant emitter in the set of point source pollution emitters, the rate of pollutant emission for each point source pollutant emitter in the set of point source pollution emitters resulting in a set of simulated parameter data streams characterized by minimal error relative to the set of observed parameter data streams based on:

the set of air sensor positions; and the model;

accessing a set of device characteristics for the set of air purification devices to be deployed within the target space; and calculating a set of device positions in the representation of the target space based on the distribution of the pollutant and the set of device characteristics.

11. A method for deploying a set of air purification devices in a target space comprising:

accessing a set of air sensor positions within a representation of the target space corresponding to a set of air sensors positioned within the target space;

at the set of air sensors, recording a set of observed parameter data streams comprising a set of pollutant concentration data streams of a pollutant, a set of air speed data streams, and a set of air direction data streams, each parameter data stream in the set of observed parameter data streams corresponding to an air sensor position in the set of air sensor positions;

simulating, via a model, a distribution of the pollutant in the representation of the target space reproducing the set of observed parameter data streams based on:

the set of air sensor positions; and the set of observed parameter data streams;

accessing a set of device characteristics for the set of air purification devices to be deployed within the target space; and calculating a set of device positions in the representation of the target space based on the distribution of the pollutant and the set of device characteristics by:

defining a set of subregions within the representation of the target space;

selecting a first subregion in the set of subregions characterized by a maximum concentration of the pollutant based on the distribution of the pollutant; and calculating a first device position in the set of device positions within the first subregion based on the set of device characteristics.

12. The method of claim 11, wherein calculating the set of device positions in the representation of the target space based on the distribution of the pollutant and the set of device characteristics further comprises:

simulating an updated distribution of the pollutant in the representation of the target space reproducing the set of observed parameter data streams based on:

the set of air sensor positions;

the set of observed parameter data streams;

the first device position; and the set of device characteristics;

selecting a second subregion in the set of subregions characterized by an updated maximum concentration of the pollutant based on the updated distribution of the pollutant; and calculating a second device position in the set of device positions within the second subregion and based on the set of device characteristics.

13. The method of claim 12, wherein simulating the updated distribution of the pollutant in the representation of the target space reproducing the set of observed parameter data streams comprises simulating the updated distribution of the pollutant in the representation of the target space reproducing the set of observed parameter data streams via a second model configured to simulate an impact of the first air purification device on the distribution of the pollutant.

14. A method for deploying a set of air purification devices in a target space comprising:

accessing a set of air sensor positions within a representation of the target space corresponding to a set of air sensors positioned within the target space;

at the set of air sensors, recording a set of observed parameter data streams, the set of observed parameter data streams comprising a set of pollutant concentration data streams of a pollutant, a set of air speed data streams, and a set of air direction data streams, each parameter data stream in the set of observed parameter data streams corresponding to an air sensor position in the set of air sensor positions;

simulating, via a model, a distribution of the pollutant in the representation of the target space based on:

the set of air sensor positions; and the set of observed parameter data streams;

accessing a set of device characteristics for the set of air purification devices to be deployed within the target space; and calculating a set of device positions in the representation of the target space based on the distribution of the pollutant and the set of device characteristics by:

selecting a first subregion in a set of subregions characterized by a maximum concentration of the pollutant based on the distribution of the pollutant;

calculating a first device position in the set of device positions within the first subregion based on the set of device characteristics;

simulating an updated distribution of the pollutant in the representation of the target space reproducing the set of observed parameter data streams based on:

the set of air sensor positions;

the set of observed parameter data streams;

the first device position; and the set of device characteristics;

selecting a second subregion in the set of subregions characterized by an updated maximum concentration of the pollutant based on the updated distribution of the pollutant; and calculating a second device position in the set of device positions within the second subregion based on the set of device characteristics.

15. The method of claim 14, wherein simulating, via the model, the distribution of the pollutant in the representation of the target space comprises simulating, via the model selected from a group of models, the distribution of the pollutant in the representation of the target space, the group of models consisting of:

a machine learning model; and a computational fluid dynamic model.

16. The method of claim 14:

wherein simulating, via the model, the distribution of the pollutant in the representation of the target space comprises simulating, via the model, a steady-state distribution of the pollutant in the representation of the target space reproducing the set of observed parameter data streams based on:

the set of air sensor positions; and the set of observed parameter data streams; and wherein the distribution of the pollutant comprises the steady-state distribution of the pollutant.

* * * * *